US009637997B2

(12) United States Patent
Goodman et al.

(10) Patent No.: US 9,637,997 B2
(45) Date of Patent: May 2, 2017

(54) PACKER HAVING SWELLABLE AND COMPRESSIBLE ELEMENTS

(71) Applicant: Weatherford/Lamb, Inc., Houston, TX (US)

(72) Inventors: Brandon C. Goodman, Kingwood, TX (US); Michael C. Derby, Houston, TX (US); Charles D. Parker, Sugar Land, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 679 days.

(21) Appl. No.: 14/014,041

(22) Filed: Aug. 29, 2013

(65) Prior Publication Data

US 2015/0060088 A1 Mar. 5, 2015

(51) Int. Cl.
*E21B 33/128* (2006.01)
*E21B 33/12* (2006.01)

(52) U.S. Cl.
CPC ..... *E21B 33/1285* (2013.01); *E21B 33/1208* (2013.01); *E21B 33/1216* (2013.01)

(58) Field of Classification Search
CPC ..... E21B 33/1208; E21B 33/1285
See application file for complete search history.

(56) References Cited

U.S. PATENT DOCUMENTS 7,387,158 B2 6/2008 Murray et al.
7,823,636 B2 11/2010 Lucas
8,342,239 B2 * 1/2013 Kutac ..... E21B 33/1216 166/179
8,408,319 B2 4/2013 Chen et al.
8,499,843 B2 8/2013 Patel et al.
2004/0055758 A1 3/2004 Brezinski et al.
2005/0072579 A1 4/2005 Gambier
2008/0023205 A1 1/2008 Craster et al.
2009/0038796 A1 2/2009 King
2009/0139707 A1 6/2009 Berzin et al.
2009/0179383 A1 7/2009 Koloy et al.
2009/0229816 A1 9/2009 Lemme et al.
2010/0243235 A1 * 9/2010 Caldwell ..... E21B 23/04 166/118

(Continued)

FOREIGN PATENT DOCUMENTS

EP 2407633 A2 1/2012

OTHER PUBLICATIONS

Int'l Search Report and Written Opinion in counterpart PCT Appl. PCT/US14/52878, dated Dec. 9, 2014.

(Continued)

*Primary Examiner* — David Andrews
(74) *Attorney, Agent, or Firm* — Blank Rome LLP

(57) ABSTRACT

A packer has a swellable element and has end rings and compressible elements at each end of the swellable element. The packer may be first set using internal bore pressure to compress one of the compressible elements against one of the end rings with a first hydraulic setting mechanism. The packer may then be set a second time using annulus pressure to compress against the other compressible element with a second hydraulic setting mechanism. Either way, the compressible elements are compressed to expand out to the borehole and to limit extrusion of the swellable element outside the compressed elements.

24 Claims, 8 Drawing Sheets

(56) References Cited

U.S. PATENT DOCUMENTS

| | | | | |
|---|---|---|---|---|
| 2010/0276137 | A1* | 11/2010 | Nutley | E21B 33/1216 166/185 |
| 2010/0288486 | A1* | 11/2010 | Kutac | E21B 33/1277 166/118 |
| 2011/0100643 | A1 | 5/2011 | Themig et al. | |
| 2011/0186307 | A1 | 8/2011 | Derby | |
| 2011/0297368 | A1 | 12/2011 | Lembcke | |
| 2012/0012342 | A1 | 1/2012 | Wilkin et al. | |
| 2012/0125640 | A1* | 5/2012 | Sevre | E21B 33/128 166/387 |
| 2013/0233574 | A1* | 9/2013 | Themig | E21B 33/1285 166/387 |

OTHER PUBLICATIONS

Patent Examination Report No. 1 in counterpart Australian Appl. 2014312415, dated Jun. 6, 2016, 2-pgs.
Examination Report in counterpart UK Appl. GB1603492.8, dated Apr. 22, 2016, 1-pg.

* cited by examiner

PACKER HAVING SWELLABLE AND COMPRESSIBLE ELEMENTS

BACKGROUND

In connection with the completion of oil and gas wells, it is frequently necessary to utilize packers in both open and cased bore holes for a number of reasons. For example, a section of the well may be packed off to permit applying pressure to a particular section of the well, such as when fracturing a hydrocarbon bearing formation, while protecting the remainder of the well from the applied pressure.

In a staged frac operation, for example, multiple zones of a formation need to be isolated sequentially for treatment. To achieve this, operators install a fracture assembly 10 such as shown in FIG. 1 in a wellbore 12. Typically, the assembly 10 has a top liner packer (not shown) supporting a tubing string 14 in the wellbore 12. Packers 50 on the tubing string 14 isolate the wellbore 12 into zones 16A-C, and various sliding sleeves 20 on the tubing string 14 can selectively communicate the tubing string 14 with the various zones 16A-C. When the zones 16A-C do not need to be closed after opening, operators may use single shot sliding sleeves 20 for the frac treatment. These types of sleeves 20 are usually ball-actuated and lock open once actuated. Another type of sleeve 20 is also ball-actuated, but can be shifted closed after opening.

Initially, all of the sliding sleeves 20 are closed. Operators then deploy a setting ball to close a wellbore isolation valve (not shown), which seals off the downhole end of the tubing string 14. At this point, the packers 50 are hydraulically set by pumping fluid with a pump system 35 connected to the wellbore's rig 30. The build-up of tubing pressure in the tubing string 14 actuates the packers 50 to isolate the annulus 18 into the multiple zones 16A-C. With the packers 50 set, operators rig up fracturing surface equipment and pump fluid down the tubing string 14 to open a pressure actuated sleeve (not shown) so a first downhole zone (not shown) can be treated.

As the operation continues, operators drop successively larger balls down the tubing string 14 to open successive sleeves 20 and pump fluid to treat the separate zones 16A-C in stages. When a dropped ball meets its matching seat in a sliding sleeve 20, fluid is pumped by the pump system 35 down the tubing string 14 and forced against the seated ball to shift the sleeve 20 open. In turn, the seated ball diverts the pumped fluid out ports in the sleeve 20 to the surrounding annulus 18 between packers 50 and into the adjacent zone 16A-C and prevents the fluid from passing to lower zones 16A-C. By dropping successively increasing sized balls to actuate corresponding sleeves 20, operators can accurately treat each zone 16A-C up the wellbore 12.

The packers 50 typically have a first diameter to allow the packer 50 to be run into the wellbore 12 and have a second radially larger size to seal in the wellbore 12. The packer 50 typically consists of a mandrel about which the other portions of the packer 50 are assembled. Typically, when the packer 50 is set, fluid pressure is applied from the surface via the tubular string 14 and typically through the bore of the tubular string 14. The fluid pressure is in turn applied through a port on the packer 50 to the packer's piston, which compresses the sealing element longitudinally.

Most sealing elements are an elastomeric material, such as rubber. When the sealing element is compressed in one direction it expands in another. Therefore, as the sealing element is compressed longitudinally, it expands radially to form a seal with the well or casing wall.

In some situations, operators may want to utilize comparatively long sealing elements in their packers 50. Additionally, operators may want to seal against open hole boreholes with irregular surfaces. In these instances, operators may use packers with swellable elements to seal off the borehole. Although existing packers used downhole may be effective, operators are continually striving to improve the operation and sealing capability for packers used downhole.

SUMMARY

A packer for a borehole has a swellable element, first and second compressible elements, and at least a first setting mechanism. The swellable element is disposed on the packer and has first and second ends. As will be appreciated, the swellable element can be a unitary sleeve of swellable material or can be constructed of several components. During operation, the swellable element can swell in the presence of an activating agent (e.g., water, oil, etc.) to seal in the borehole. As will be appreciated, swelling of the swellable element can occur over an extended period of time depending on the material used and the exposure to the activating agent.

To limit the extrusion of the swellable element, the first and second compressible elements are disposed on the packer respectively outside the first and second ends of the swellable element. The compressible elements at least include rings, sleeves, or other such sealing components disposed on the packer and composed of a compressible material, such as a conventional elastomer used for sealing elements on packers. In one arrangement, the compressible elements further include first and second end rings disposed on the packer respectively between the compressible element and the swellable element's ends. In this instance, the first and second end rings can be rigid components composed of metal or the like and can be at least temporarily affixed in place on the packer using shear screws or other attachment. In another arrangement, the first and second end rings can be movable on the packer. In this instance, a sleeve can be connected between the movable end rings so that they move together on the packer. The swellable element disposed between the end rings can be disposed on this sleeve.

To activate the compressible elements so that they radially expand toward the borehole, the first setting mechanism is disposed on the packer adjacent the first compressible element and is actuatable toward the first compressible element. Compressing against the first compressible element with the actuated setting mechanism may also partially compress and radially expand at least a portion of the swellable element in some instances, especially when the compressible element is movable on the packer to some extent or after some threshold.

In one example, the first setting mechanism can be hydraulically actuated and can have a piston toward the first compressible element in response to fluid pressure communicated inside the packer. When actuated, the first setting mechanism compresses at least the first compressible element toward the first end of the swellable element and against the first end ring if present. In either case, the compressed element radially expands toward the surrounding borehole and can limit extrusion of the swellable element beyond the compressed element.

In some arrangements, a fixed end ring can be disposed adjacent the second compressible element on the other side of the swellable element from the first setting mechanism. In this case, the second compressible element is compressed by the first setting mechanism when the various compressible elements, end rings, and swellable element are able to move on the packer and transfer the longitudinal compression force from the first setting mechanism to the second compressible element sandwiched against the fixed end ring.

In other arrangements, the packer can have a second setting mechanism disposed on the packer adjacent the second compressible element and set to oppose the first setting mechanism. This second mechanism is also actuatable to compress at least the second compressible element against the second end of the swellable element (or the end ring if present). In this way, the compressed second compressible element can limit extrusion of the swellable element beyond the second element.

The first and second setting mechanisms can be the same as each other or can be different from one another. Likewise, the two mechanisms can be actuated sequentially or in tandem. For instance, the second setting mechanism can be different from the first setting mechanism and can be actuated after the first setting mechanism. In this arrangement, the first setting mechanism can compress against the first compressible element with a piston in response to fluid pressure communicated inside the packer. However, the second setting mechanism can compress against the second compressible element in response to fluid pressure communicated in the borehole external to the packer. Consequently, the second setting mechanism may be actuated when initial sealing of the borehole is achieved and pressure in the borehole increase relative to the pressure in the packer. This may occur during a treatment operation of the borehole when the interior of the packer is isolated so borehole pressure can be increased in the borehole through a sliding sleeve on a toolstring, for example.

As used herein, the terms such as lower, downward, downhole, and the like refer to a direction towards the bottom of the well, while the terms such as upper, upwards, uphole, and the like refer to a direction towards the surface. The uphole end is referred to and is depicted in the Figures at the top of each page, while the downhole end is referred to and is depicted in the Figures at the bottom of each page. This is done for illustrative purposes in the following Figures. The tool may be run in a reverse orientation.

DETAILED DESCRIPTION

The description that follows includes exemplary apparatus, methods, techniques, and instruction sequences that embody techniques of the inventive subject matter. However, it is understood that the described embodiments may be practiced without these specific details.

Figure 1:
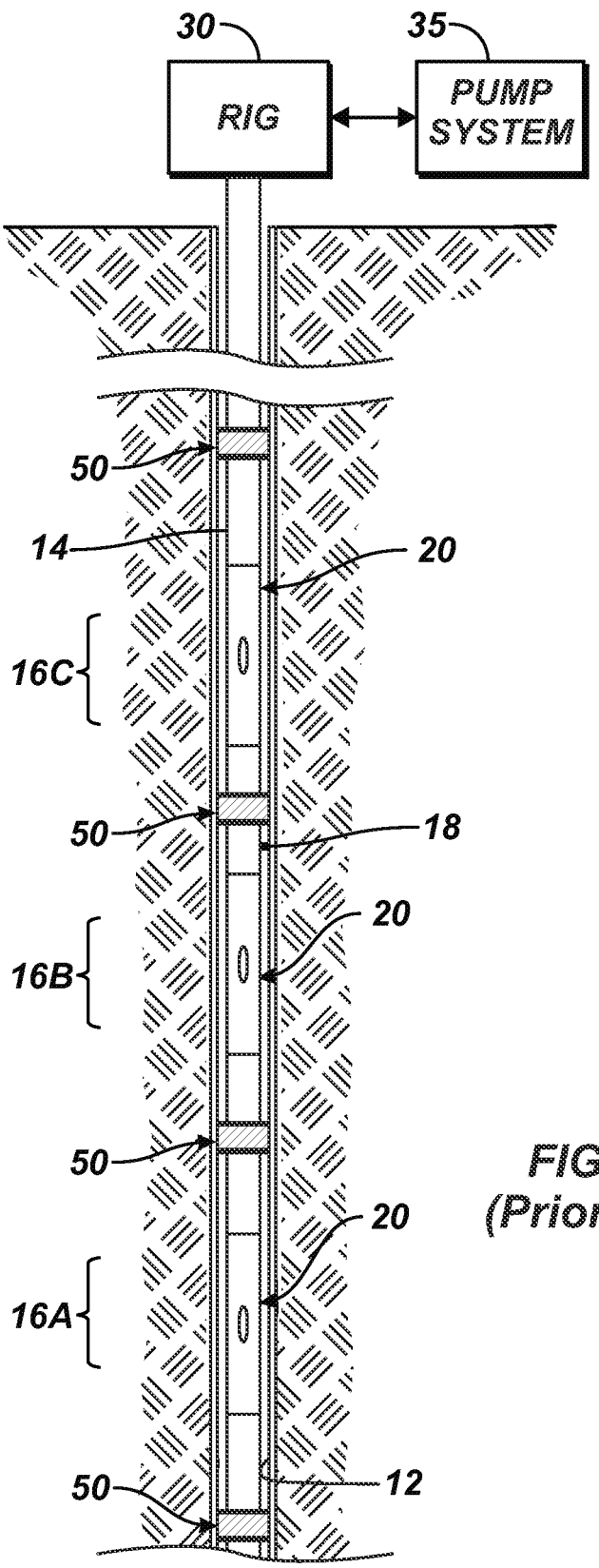
FIG. 1 (Prior Art)
FIG. 1 diagrammatically illustrates a tubing string having multiple sleeves and packers of a fracture system.
Figure 2A:
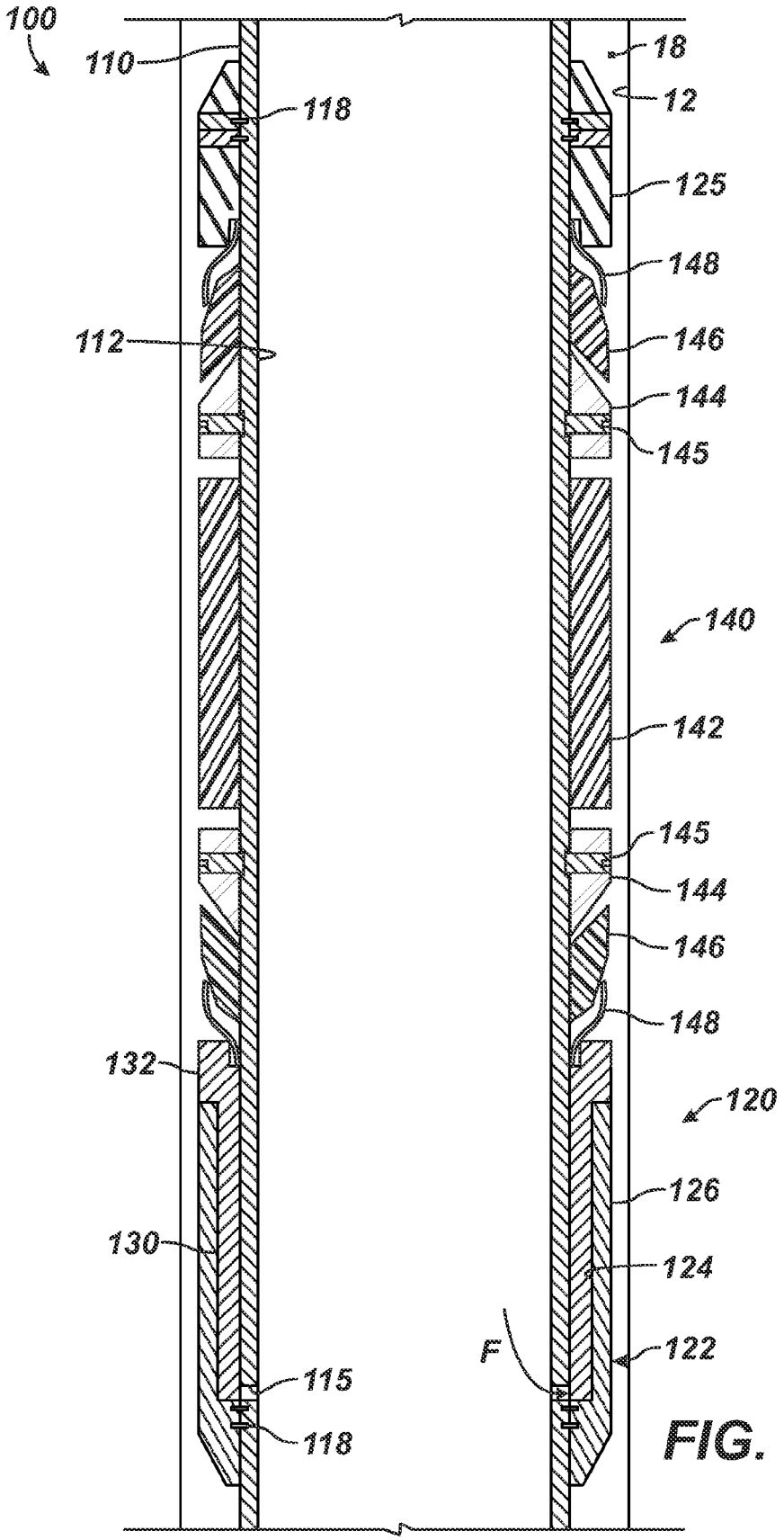
FIG. 2A illustrates a cross-sectional view of a packer according to the present disclosure in a run-in condition having swellable and compressible elements.

FIG. 2A depicts a packer 100 according to the present disclosure in an unset or run-in condition in a wellbore 12, which may be a cased or open hole. The packer 100 includes a mandrel 110 with an internal bore 112 passing therethrough that connects on a tubing string (14: FIG. 1) using known techniques. In the present embodiment, the packer 100 is hydraulically set and includes a hydraulic setting mechanism 120 disposed adjacent to an end of a sealing assembly 140. In other arrangements, the packer 100 can be mechanically-set or hydrostatically-set having appropriate mechanisms for each, such as a sliding sleeve, hydrostatic chamber, and other known components. As will be appreciated, the sealing assembly 140 may be longer or shorter than depicted and may comprise several pieces.

In general and as shown in FIG. 2A, the setting mechanism 120 can be disposed on one end of the packer 100, while a fixed ring 125 can be disposed at the opposite end of the sealing assembly 140. As will be appreciated with the benefit of the present disclosure, a reverse arrangement can be used, depending on the implementation, orientation, and access to tubing and annulus pressures in the wellbore 12.

For this hydraulically-set arrangement, the setting mechanism 120 on the first (downhole) end of the packer 100 has a fixed ring 122 affixed to the mandrel 110 by lock wire 118, pins, or the like. Part of this fixed ring 122 forms a housing 126 having an inner surface, which forms an internal cylinder chamber 124 in conjunction with the external surface of the mandrel 110. Although not shown, various seals can be provided as conventionally done. Also, the housing 126 can be composed of several components, which can facilitate assembly of the mechanism 120.

A push rod or piston 130 resides in the cylinder chamber 124 and has its end surface exposed to the chamber 124. Accordingly, the push rod 130 acts as a piston in the presence of pressurized fluid F (FIG. 2B) communicated from the internal bore 112 of the mandrel 110 into the chamber 122 through one or more internal ports 115. Although not specifically shown, the piston 130 can use a body lock ring (not shown) or other such feature to lock it in place once moved by hydraulic pressure.

During a setting operation, for example, fluid pressure is communicated downhole through the tubing string (14: FIG. 1) and eventually enters the internal bore 112 of the packer's mandrel 110. This setting operation can be performed after run-in of the packer 100 in the wellbore 12 so that the packer 100 can be set and zones of the wellbore's annulus 18 can be isolated from one another. While the tubing pressure inside the packer 100 is increased, external fluid pressure in the annulus 18 surrounding the packer 100 remains below the tubing pressure. At this point, the packer 100 begins its setting procedure in which the setting mechanism 120 is activated to compress the sealing assembly 140.

Figure 2B:
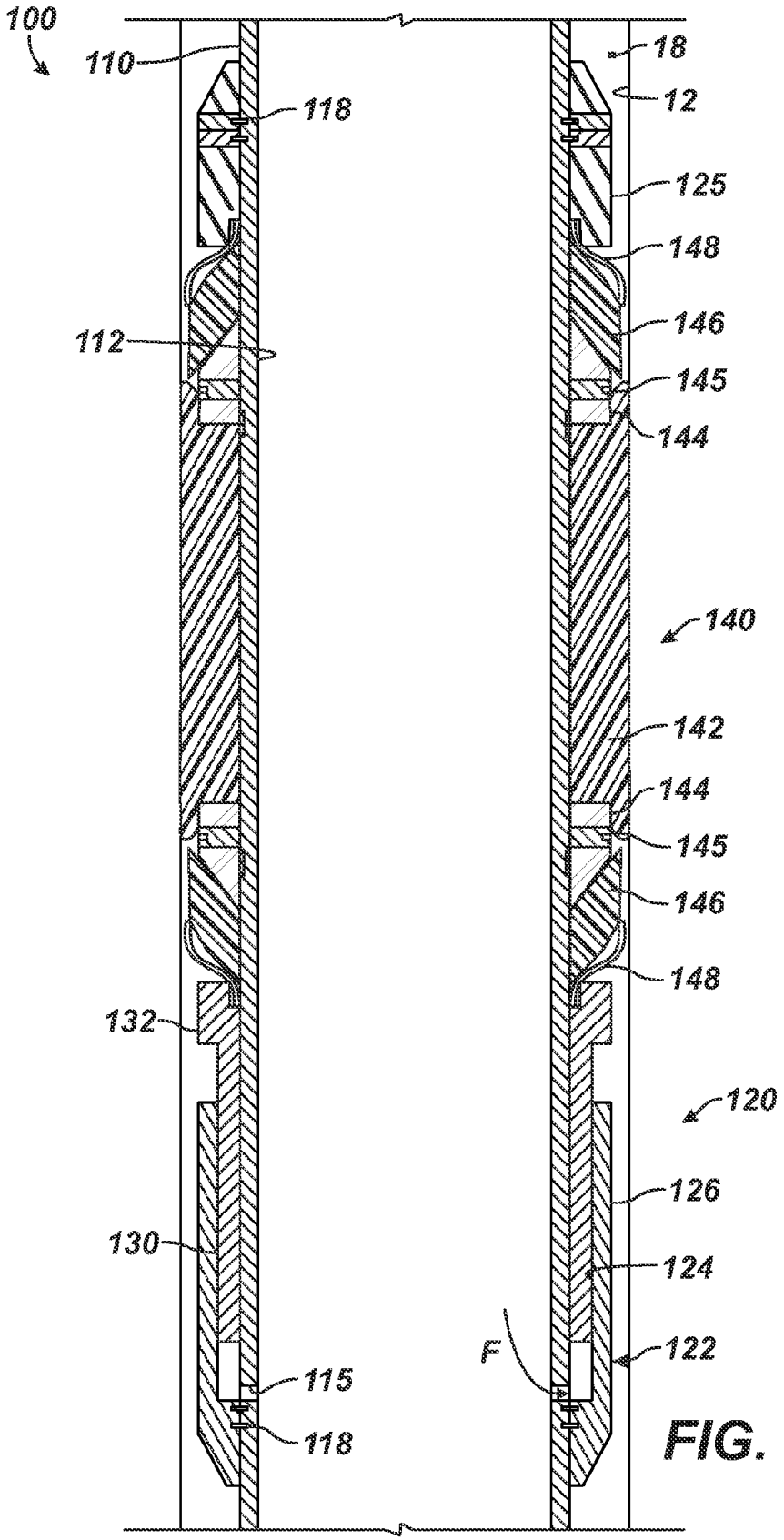
FIG. 2B illustrates a cross-sectional view of the packer of FIG. 2A in an actuated condition.

FIG. 2B depicts the packer 100 during a stage of the setting procedure. Pressurized fluid F in the mandrel's bore 112 accesses the piston 130 in the cylinder chamber 124 through the one or more internal ports 115 in the mandrel 110. Building in the chamber 124, the pressurized fluid F acts on the piston 130 and forces the piston's end 132 against one end of the sealing assembly 140 disposed on the mandrel 110. As the piston 130 moves along the mandrel 110, it longitudinally compresses against the sealing assembly 140. In turn, as the sealing assembly 140 is longitudinally compressed, the assembly 140 radially expands toward the surrounding borehole 12.

As depicted in FIG. 2B, radial expansion also occurs due to the swelling of the swellable element 142 of the assembly 140. As such, the swellable element 142 can be composed of any appropriate swellable material known in the art and can swell in the presence of any know activating agent, e.g., water, mud, oil, etc. This swelling can take some time. In any event, the radial expansion of the sealing assembly 140 against the wellbore 12 separates the annulus 18 into an uphole annular region and a downhole annular region.

During the setting operation and preferably before full swelling of the swellable element 142, one or more rings 144, 146, and 148 on the mandrel 110 are used to limit extrusion of the swellable element 142 and/or to compress the swellable element 142. In the depicted arrangement, inner anti-extrusion end rings 144 are affixed at least temporarily to the mandrel 110 by shear pins 145 or other temporary attachments. These end rings 144 can be rigid composed of metal or other suitable material. Outside the inner end rings 144 lie outer anti-extrusion end rings 146. One end ring 146 abuts the piston 130 of the setting mechanism 120, while the other ring 146 abuts the fixed ring 125 on the opposite end of the sealing assembly 140.

In other arrangements not depicted, the inner end rings 144 may be optional so that the outer end rings 146 abut the ends of the swellable element 142. In yet another arrangement, the inner end rings 144 may not be temporarily affixed to the mandrel 110. However, use of the inner end rings 114 at least temporarily affixed to the mandrel 110 may be preferred because they provide a barrier against which the compressible elements on the outer end rings 146 can be compressed and because they provide a barrier to limit extrusion of the swellable element 142.

The outer end rings 146 are preferably compressible elements, such as sleeves, rings, packing seals, or the like composed of a compressible material, such as an elastomer commonly used for compressible packing elements on packers. When compressed, these outer end rings 146 expand radially outward to the surrounding wall and can act as anti-extrusion features preventing the swellable element 142 from over extruding. The outer end rings 146 may also be configured to engage the surrounding wall and may, thereby, act as part of the sealing barrier in the annulus.

As an additional anti-extrusion feature, fold-back or back-up rings 148 can be disposed between the outer end rings 146 and the piston 130 and fixed ring 125. These rings 148 are typically composed of metal or plastic and open outward to prevent over extrusion of the packing elements (i.e., swellable element 142 and compressible elements 146). Additional such back-up rings 148 can be used elsewhere, such as at the ends of the swellable element 142.

During setting, the inner rings 144 shear free from the mandrel 110 due to the force of the setting mechanism 120 so the inner rings 144 can slide along the mandrel 110. The outer anti-extrusion rings 146 compress and expand outwardly by being sandwiched between the inner rings 144 and the piston 130 and fixed end ring 125. The swellable element 142 may also experience some compression and corresponding radial expansion by being sandwiched between the inner rings 144. Overall, however, the swellable element 142 swells in the presence of an activating agent over a usually extended period of time.

Although the packer 100 can be used with a sliding sleeve arrangement as in FIG. 1, the packer 100 can be used for any suitable intervention, completion, and production operation. As but one example, the packer 100 can be used for zonal isolation between screens of a gravel pack system for adjacent completion zones. As will be appreciated, the disclosed packer 100 can be used for these and other systems.

Figure 3A:
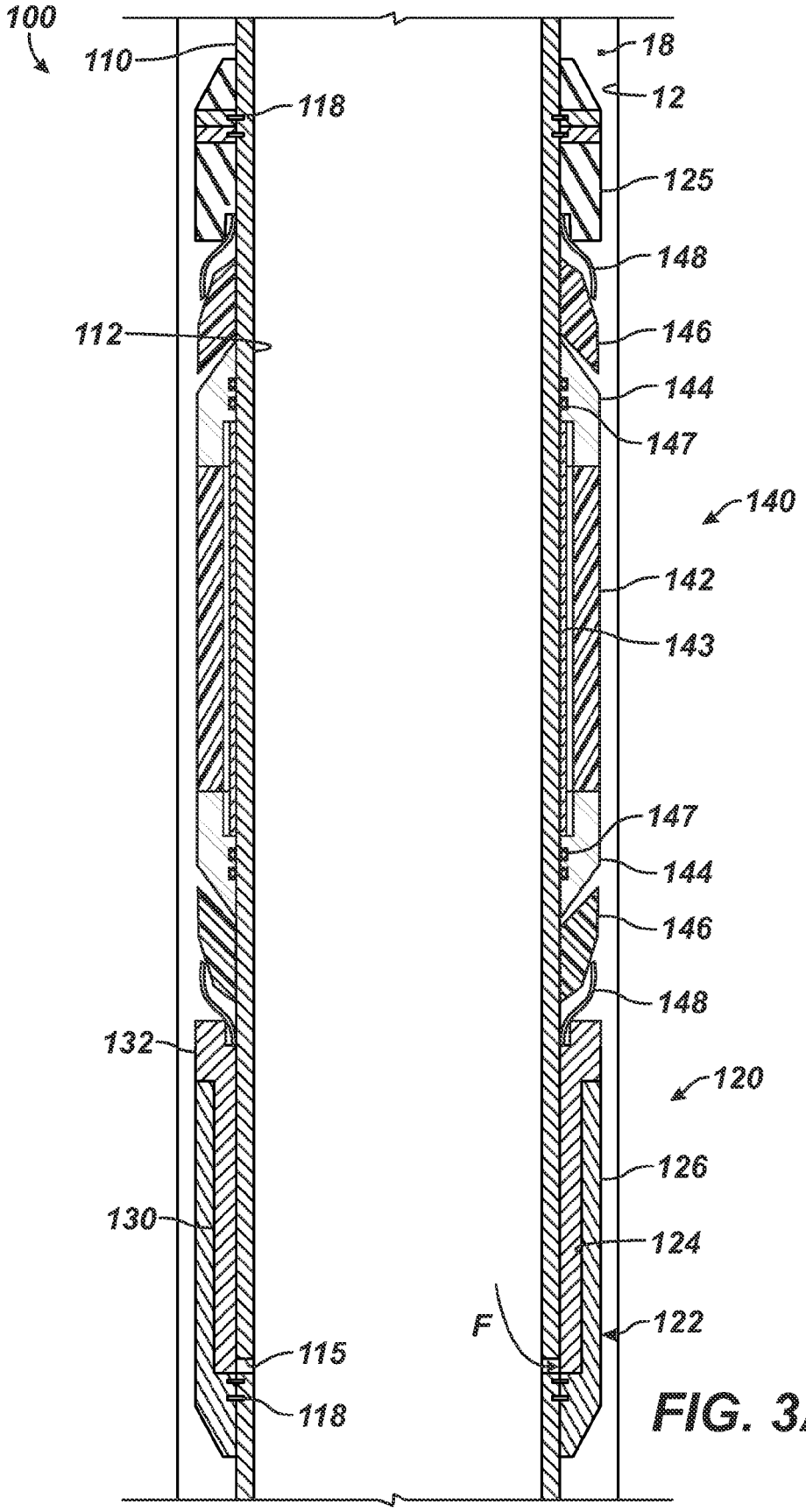
FIG. 3A illustrates a cross-sectional view of another packer according to the present disclosure in a run-in condition having swellable and compressible elements.

FIG. 3A depicts another packer 100 according to the present disclosure in an unset or run-in condition in a wellbore 12, which may be a cased or open hole. The packer 100 is similar in many respects to that discussed above so like reference numerals are used for comparable features. For brevity, some applicable description between the two packers of FIGS. 2A and 3A is not repeated here, but could apply equally to both.

Again, the packer 100 includes a mandrel 110 with an internal bore 112 passing therethrough that connects on a tubing string (14: FIG. 1) using known techniques. In the present embodiment, the packer 100 is hydraulically set and includes a hydraulic setting mechanism 120 disposed adjacent to an end of a sealing assembly 140. In other arrangements, the packer 100 can be mechanically-set or hydrostatically-set having an appropriate mechanism for each, such as a sliding sleeve, hydrostatic chamber, and other known components.

Rather than having inner anti-extrusion rings affixed by shear pins or the like to the mandrel 110, the packer 100 of FIG. 3A has inner rings 144 disposed with seals 147 against the mandrel 100. These inner rings 144 may not be held with temporary attachments. In either case, the inner rings 144 can move along the mandrel 110 and are interconnected by an intermediate sleeve 143 on which the swellable element 142 is disposed.

Figure 3B:
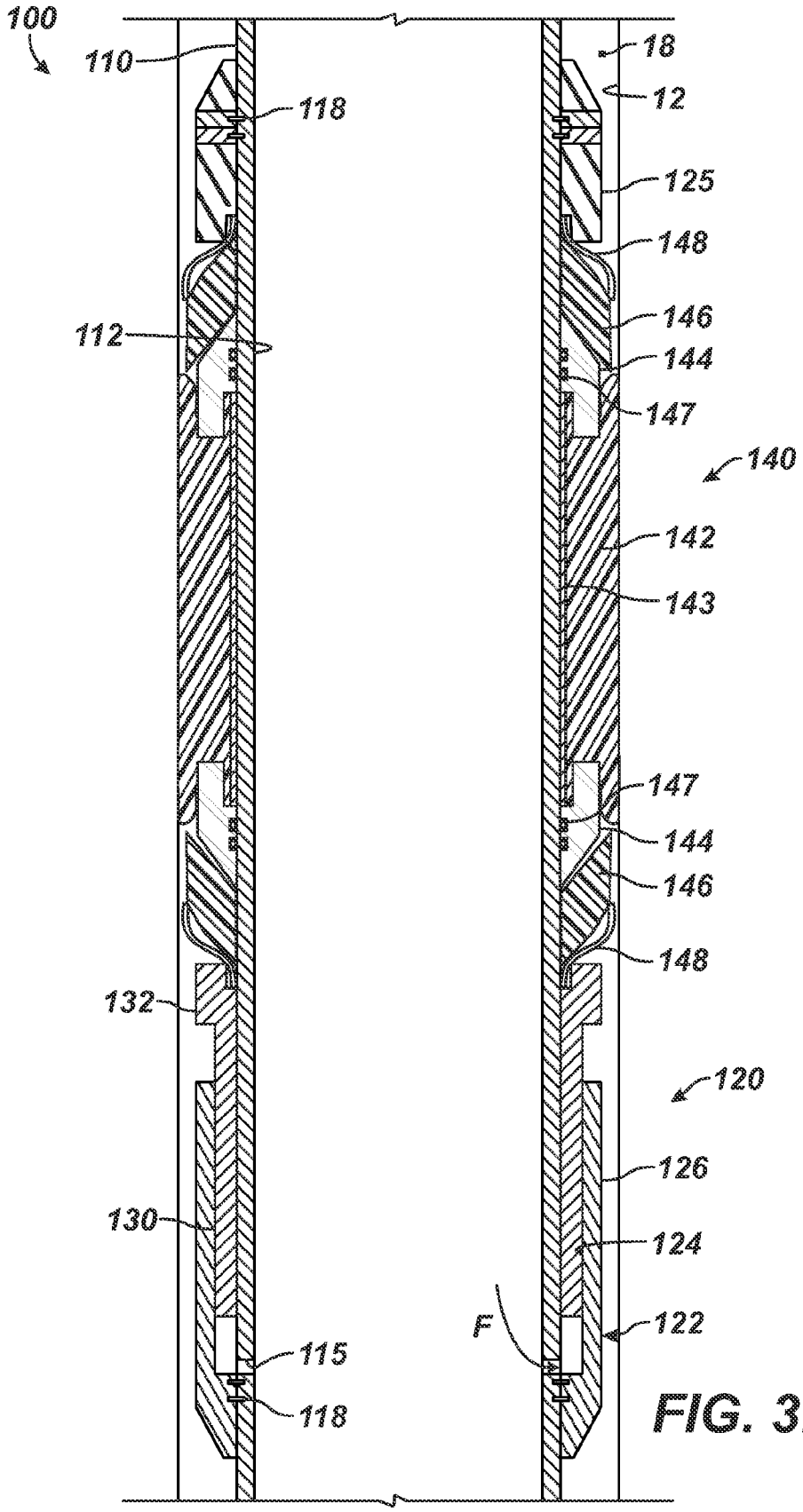
FIG. 3B illustrates a cross-sectional view of the packer of FIG. 3A in an actuated condition.

As shown in FIG. 3B during a stage of setting of the packer 100, pressurized fluid F in the mandrel's bore 112 accesses the piston 130 in the cylinder chamber 124 through the one or more internal ports 115 in the mandrel 110. Building in the chamber 124, the pressurized fluid F acts on the piston 130 and forces the piston's end 132 against one end of the sealing assembly 140 disposed on the mandrel 110. As the piston 130 moves along the mandrel 110, it longitudinally compresses against the sealing assembly 140. In turn, as the sealing assembly 140 is longitudinally compressed, the assembly 140 radially expands from a first diameter to a second diameter toward the surrounding borehole 12.

As depicted in FIG. 3B, radial expansion also occurs due to the swelling of the swellable element 142 of the assembly 140. As such, the element 142 can be composed of any appropriate swellable material known in the art and can swell in the presence of any know activating agent, e.g., water, mud, oil, etc. In any event, the radial expansion of the sealing assembly 140 against the wellbore 12 separates the annulus 18 into an uphole annular region and a downhole annular region.

During setting, the inner anti-extrusion rings 144 move together along the mandrel 110, sealed with seals 147, and maintain their separation due to the intermediate sleeve 143. Thus, the swellable element 142 may not undergo appreciable compression during the setting procedure. Overall, the swellable element 142 swells in the presence of an activating agent over a usually extended period of time. The outer anti-extrusion rings 146 preferably composed of a compressible material, however, are compressed to radially expand outward to the surrounding wall and provide anti-extrusion for the swellable element 142.

Figure 4:
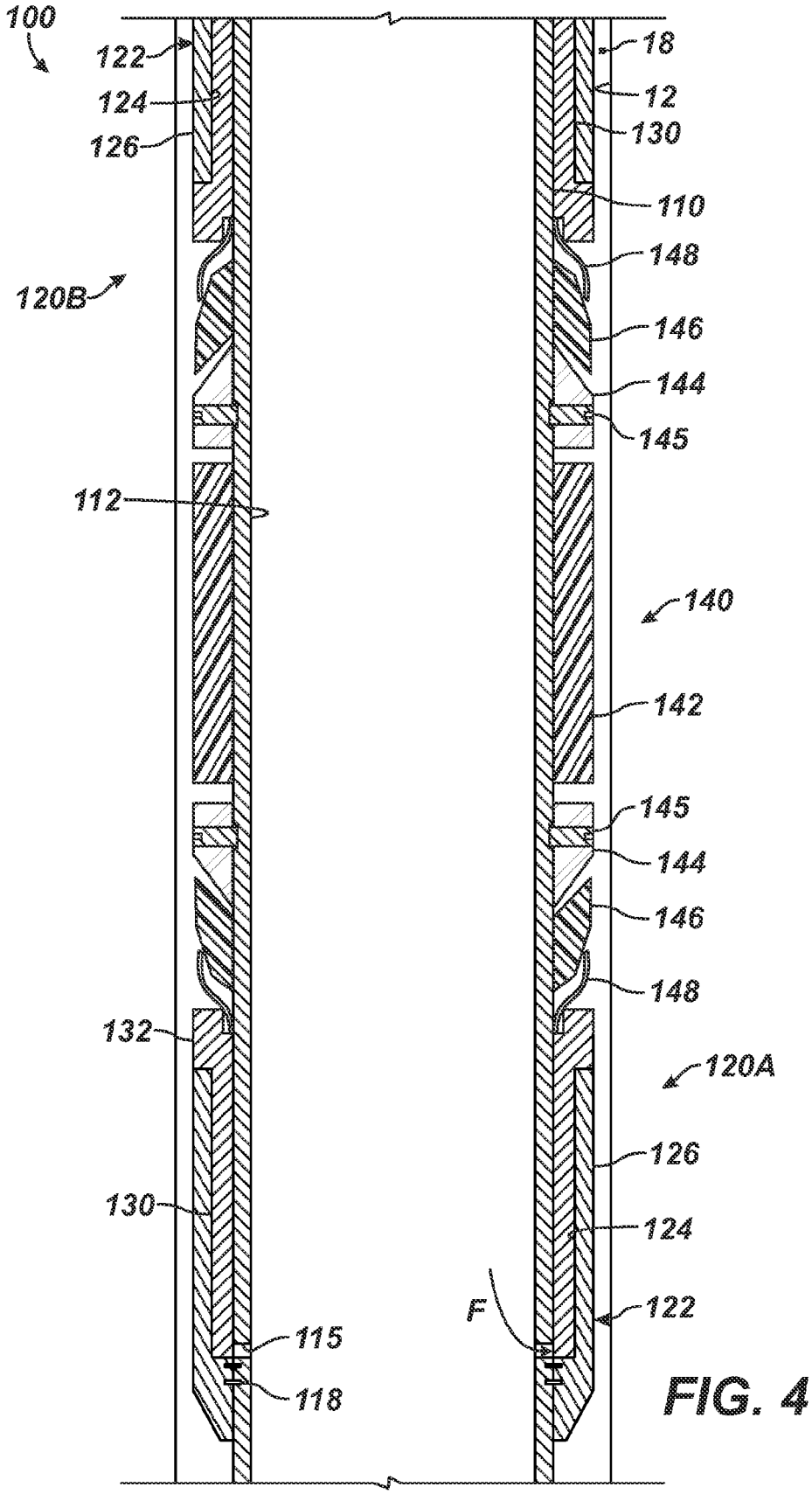
FIG. 4 illustrates a cross-sectional view of a packer having the actuator mechanism of FIG. 2A on both ends of the swellable and compressible elements.
Figure 5:
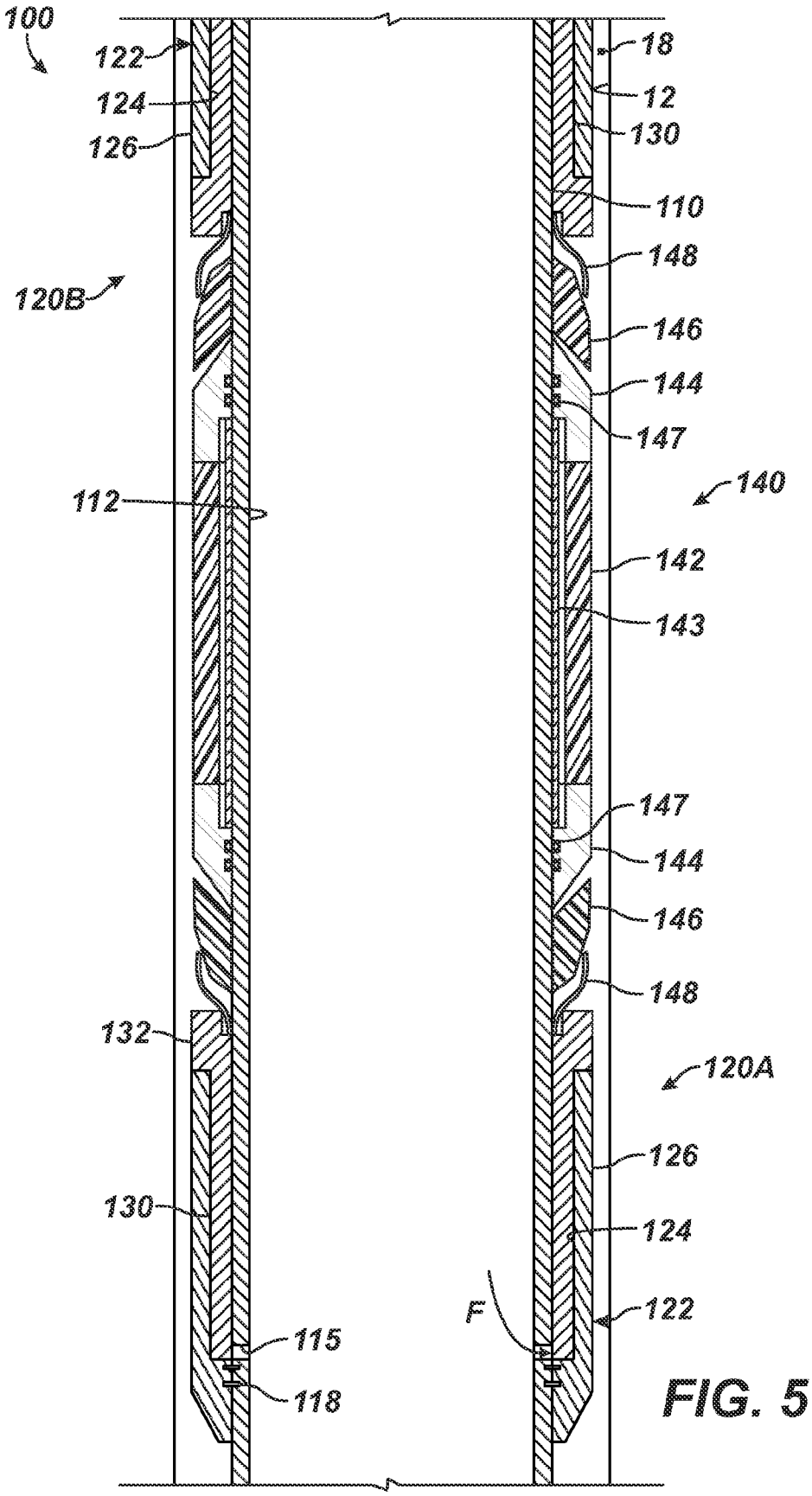
FIG. 5 illustrates a cross-sectional view of a packer having the actuator mechanism of FIG. 3A on both ends of the swellable and compressible elements.

In additional arrangements, the packers 100 of FIGS. 2A and 3A can be arranged symmetrically from end to end. Thus, as shown in FIG. 4, the packer 100 arrangement of FIG. 2A can have opposing setting mechanisms 120A-B. Similarly, as shown in FIG. 5, the packer 100 of the arrangement of FIG. 3A can have opposing setting mechanisms 120A-B. Both of the mechanisms 120A-B can be comparably actuated, although other variations can be used.

Figure 6:
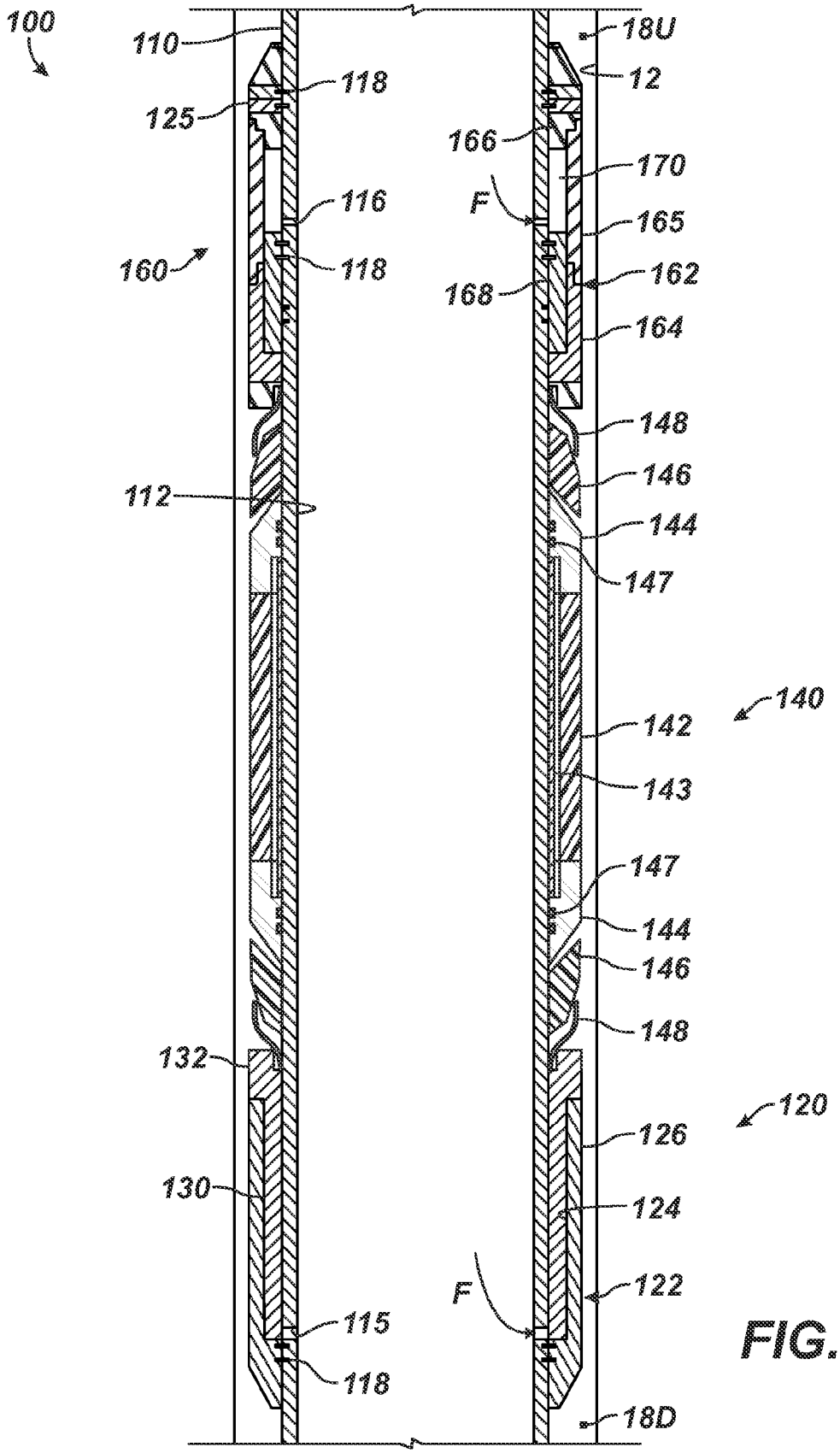
FIG. 6 illustrates a cross-sectional view of a packer having the actuator mechanism of FIG. 2A on one end of the swellable and compressible elements and having a second actuator mechanism on the other end.

Moreover, the two setting mechanisms on the packer 100 need not be the same type of mechanism or operate at the same time. In fact, the second setting mechanism can be based on the teachings from co-pending application Ser. No. 13/826,021, entitled "Double Compression Set Packer," which is incorporated herein by reference in its entirety. For instance, FIG. 6 shows an embodiment of the packer 100 with the sealing assembly 140 of FIG. 2A, but having different setting mechanisms. One mechanism 120 operates as described before. The other mechanism 160, however, operates as disclosed in the incorporated U.S. application Ser. No. 13/826,021.

Turning to the details of this second mechanism 160, a second end ring 125 is fixed to the mandrel 110 by lock wires 118 or the like and is disposed adjacent to a piston 162 of the mechanism 160. The piston 162 can be composed of several components, including a push rod end 164 connected by an intermediate sleeve 165 to a piston end 166. Use of these multiple components 164, 165, and 166 can facilitate assembly of the mechanism 160, but other configurations can be used.

The push rod end 164 of the piston 162 is disposed against the sealing assembly 140. On the other end, the piston end 166 is disposed adjacent to the end ring 125, but the piston end 166 is subject to effects of fluid pressure in an uphole annular region 18U, as will be discussed further below. A fixed piston 168 is attached to the mandrel 110 by lock wire 118 or the like, and the fixed piston 168 encloses the piston chamber 170 of the piston 162. The chamber 170 is isolated by various seals (not shown) from fluid pressure in the uphole annular region 18U formed by the packer 100 and the wellbore 12.

As long as the second hydraulic setting mechanism 160 remains in an unactuated state as in FIG. 6, the chamber 170 does not decrease or increase in volume. During operation, for example, fluid pressure F in the mandrel 110 entering second ports 116 for the second mechanism 160 does not activate this mechanism 160. Instead, fluid pressure entering a chamber 170 of the second mechanism 160 during the setting procedure actually tends to keep the second mechanism 160 in its original position so that the mechanism 160 acts as a fixed stop for the compression of the sealing assembly 140.

However, after the first mechanism 120 is actuated and the sealing assembly 140 is at least partially set, external fluid pressure F in the uphole annular region 18U may be increased, which will then actuate the second mechanism 160. For example, during a fracture treatment, operators fracture zones downhole from the disclosed packer 100 by pumping fluid pressure downhole, which merely communicates through the mandrel's bore 112 to further downhole components. The buildup of tubing pressure may tend to further set the first hydraulic setting mechanism 120, but the second hydraulic setting mechanism 160 may stay unactuated, as noted above.

Then, operators isolate the packer's internal bore 112 uphole of the packer 100. For example, operators may drop a ball down the tubing string (14: FIG. 1) to land in a seat of a sliding sleeve (20: FIG. 1) uphole of this packer 100. When the sliding sleeve (20) is opened and fracture pressure is applied to the formation through the open sleeve (20), the borehole pressure in the uphole annular region 18U increases above the isolated tubing pressure in the mandrel's bore 112. At the same time, the internal pressure in the mandrel's bore 112 does not increase due to the plugging by the set ball on the seat in the uphole sliding sleeve (20). It is this buildup of borehole pressure in the uphole annular region 18U outside the packer 100 compared to the tubing pressure inside the packer 100 that activates the second mechanism 160.

With a sufficient buildup of pressure in the uphole annular region 18U, for example, the external pressurized fluid in the region 18U acts upon the external face of the piston end 166. Chamber 170, which is at the lower tubing pressure, is sealed from the external pressure from the annular region 18U. Thus, an internal face of the piston end 166 is exposed to the lower tubing pressure in the chamber 170. Consequently, the pressure differential causes the second piston 162 to move along the mandrel 110 and exert a force against the sealing assembly 140.

As the piston 162 moves, it further compresses the sealing assembly 140. At the same time, the lower tubing pressure in the chamber 170 can escape into the mandrel's bore 112 through ports 116 while the chamber 170 decreases in volume with any movement of the piston 162. Also, as the piston 162 moves, it longitudinally compresses against the sealing assembly 140, which can radially expand further or more fully against the wellbore 12, thereby further completing the radial expansion of the sealing assembly 140 against the surrounding wellbore 12.

While the embodiments are described with reference to various implementations and exploitations, it will be understood that these embodiments are illustrative and that the scope of the inventive subject matter is not limited to them. Many variations, modifications, additions and improvements are possible.

For example, although not shown in the Figures, the packer 100 may use any of the conventional mechanisms for locking the push rods or pistons (e.g., 130 and 162) in place on the mandrel 110 once set against the sealing assembly 140. Accordingly, ratchet mechanisms, lock rings, or the like (not shown) can be used to prevent the rods or pistons from moving back away from the sealing assembly 140 once set. Additionally, various internal seals, threads, and other conventional features for components of the packer 100 are not shown in the Figures for simplicity, but would be evident to one skilled in the art.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A packer for use on a tubing string in a borehole, the tubing string having a downhole component downhole of the packer and having an uphole component uphole of the packer, the packer comprising:

a swellable element for sealing in the borehole disposed on the packer and having first and second ends, the first end disposed toward the downhole component on the tubing string, the second end disposed toward the uphole component on the tubing string;

first and second end rings disposed on the packer respectively outside the first and second ends of the swellable element;

first and second compressible elements disposed on the packer respectively outside the first and second end rings;

a first setting mechanism disposed on the packer adjacent the first compressible element and being actuatable toward the first compressible element, the actuated first setting mechanism compressing at least the first compressible element against the first end ring, the compressed first compressible element limiting extrusion of the swellable element beyond the first compressible element; and a second setting mechanism disposed on the packer adjacent the second compressible element and being actuatable toward the second compressible element, the actuated second setting mechanism compressing at least the second compressible element against the second end ring, the compressed second compressible element limiting extrusion of the swellable element beyond the second compressible element wherein the first setting mechanism is actuated before the second setting mechanism in response to tubing pressure in the tubing string communicated to the downhole component on the tubing string; and wherein the second setting mechanism is actuated after the first setting mechanism in response to borehole pressure communicated to the borehole from the uphole component on the tubing string.

2. The packer of claim 1, wherein the first and second setting mechanisms are different.

3. The packer of claim 1, wherein the first setting mechanism compresses against the first compressible element in response to the tubing pressure communicated inside the packer.

4. The packer of claim 3, wherein the second setting mechanism compresses against the second compressible element in response to the borehole pressure communicated in the borehole external to the packer.

5. The packer of claim 1, further comprising backup rings disposed respectively outside the compressible elements.

6. The packer of claim 1, wherein the first setting mechanism is hydraulically actuated with the tubing pressure.

7. The packer of claim 6, wherein the first setting mechanism comprises a first piston movable relative to the first compressible element in response to the tubing pressure communicated inside the packer.

8. The packer of claim 1, wherein the first and second end rings are at least temporarily affixed in place on the packer.

9. The packer of claim 1, wherein the first and second end rings are movably disposed on the packer.

10. The packer of claim 1, further comprising:

a sleeve connected between the first and second end rings and having the swellable element disposed thereon, the sleeve preventing relative movement of the first and second rings toward one another.

11. A method of actuating a packer disposed on a tubing string in a borehole between uphole and downhole components, the method comprising:

actuating a first setting mechanism on the packer by pressuring up an interior of the packer with tubing pressure communicated down the tubing string to the downhole component;

compressing with the actuated first setting mechanism a first compressible element on the packer toward a first end of a swellable element disposed on packer;

actuating a second setting mechanism on the packer after actuating the first setting mechanism by pressuring up in the borehole external to the packer with borehole pressure communicated to the borehole from the uphole component;

compressing with the actuated second setting mechanism a second compressible element on the packer toward a second end of the swellable element;

swelling the swellable element;

limiting extrusion of the swellable element beyond the compressed first compressible element; and limiting extrusion of the swellable element beyond the compressed second compressible element.

12. The method of claim 11, wherein compressing toward the first end of the swellable element comprises radially expanding at least a first portion of the swellable element.

13. The method of claim 11, wherein actuating the first setting mechanism on the packer by pressuring up the interior of the packer comprises:

increasing the tubing pressure in the interior of the packer; and moving a piston on the packer in response to the increased tubing pressure.

14. The method of claim 11, wherein pressuring up in the borehole external to the packer comprises performing a treatment in a portion of the borehole adjacent the second end of the swellable element.

15. The method of claim 14, wherein performing the treatment in the portion of the borehole adjacent the second end of the swellable element comprises isolating the interior of the packer from the treatment.

16. A system for a tubing string in a borehole, the system comprising:

a downhole component disposed on the tubing string;

a packer disposed on the tubing string uphole of the downhole packer; and an uphole component disposed on the tubing string uphole of the packer, wherein the packer has a first end disposed toward the downhole component and has a second end disposed toward the uphole component, the packer comprising:

a swellable element for sealing in the borehole disposed on the packer;

first and second end rings disposed on the packer outside the swellable element respectively toward the first and second ends;

first and second compressible elements disposed on the packer respectively outside the first and second end rings;

a first setting mechanism disposed on the packer adjacent the first compressible element and being actuatable toward the first compressible element in response to tubing pressure in the tubing string communicated to the downhole component on the tubing string, the actuated first setting mechanism compressing at least the first compressible element against the first end ring, the compressed first compressible element limiting extrusion of the swellable element beyond the first compressible element; and a second setting mechanism disposed on the packer adjacent the second compressible element and being actuatable toward the second compressible element after the first setting mechanism in response to borehole pressure communicated to the borehole from the uphole component, the actuated second setting mechanism compressing at least the second compressible element against the second end ring, the compressed second compressible element limiting extrusion of the swellable element beyond the second compressible element.

17. The system of claim 16, wherein the first and second setting mechanisms are different.

18. The system of claim 16, wherein the first setting mechanism compresses against the first compressible element in response to the tubing pressure communicated inside the packer.

19. The system of claim 18, wherein the second setting mechanism compresses against the second compressible element in response to the borehole pressure communicated in the borehole external to the packer.

20. The system of claim 16, further comprising backup rings disposed respectively outside the compressible elements.

21. The system of claim 16, wherein the first setting mechanism is hydraulically actuated with the tubing pressure.

22. The system of claim 21, wherein the first setting mechanism comprises a first piston movable relative to the first compressible element in response to the tubing pressure communicated inside the packer.

23. The system of claim 16, wherein the first and second end rings are at least temporarily affixed in place on the packer.

24. The system of claim 16, wherein the uphole and downhole components each comprises a sliding sleeve.

* * * * *